US009102188B2

(12) United States Patent
Wong

(10) Patent No.: US 9,102,188 B2
(45) Date of Patent: Aug. 11, 2015

(54) RING BINDER MECHANISM

(71) Applicant: Wing Sun Wong, Ashland, MA (US)

(72) Inventor: Wing Sun Wong, Ashland, MA (US)

( * ) Notice: Subject to any disclaimer, the term of this patent is extended or adjusted under 35 U.S.C. 154(b) by 189 days.

(21) Appl. No.: 13/929,569

(22) Filed: Jun. 27, 2013

(65) Prior Publication Data

US 2014/0199111 A1 Jul. 17, 2014

Related U.S. Application Data

(63) Continuation-in-part of application No. 13/739,153, filed on Jan. 11, 2013, now Pat. No. 8,480,326.

(51) Int. Cl.

| | |
|---|---|
| ***B42F 13/00*** | (2006.01) |
| ***B42F 3/04*** | (2006.01) |
| ***B42F 13/16*** | (2006.01) |
| ***B42F 13/20*** | (2006.01) |
| ***B42F 13/26*** | (2006.01) |

(52) U.S. Cl.
CPC ..... *B42F 13/26* (2013.01)

(58) Field of Classification Search
CPC ..... B42F 13/16; B42F 13/18; B42F 13/20
USPC ..... 402/26, 29, 30, 31
See application file for complete search history.

(56) References Cited

U.S. PATENT DOCUMENTS

| | | | | |
|---|---|---|---|---|
| 1,990,136 | A * | 2/1935 | Schade | 402/30 |
| 2,179,627 | A * | 11/1939 | Handler | 402/33 |
| 2,246,068 | A * | 6/1941 | Schade | 402/32 |
| 2,332,547 | A * | 10/1943 | Auburn | 402/62 |
| 5,330,280 | A * | 7/1994 | Kaneda et al. | 402/49 |
| 2007/0286670 | A1 * | 12/2007 | Wong | 402/38 |
| 2008/0095572 | A1 * | 4/2008 | Frankeny | 402/38 |

* cited by examiner

*Primary Examiner* — Kyle Grabowski
(74) *Attorney, Agent, or Firm* — Frank Marino

(57) ABSTRACT

A ring binder mechanism has an elongate housing, a pair of locking elements, a translation bar, a pair of elongate hinge plates having mating ring halves extending there-from, a plurality of mating ring halves, and an actuator. Movement of the actuator moves the hinge plates, translation bar, and locking elements to cause the ring halves to disengage so a user can place holed paper over the open ring halves, or closes the ring halves together to secure the paper with the closed-loop rings thus form while simultaneously locking the rings in the closed-loop configuration to prevent inadvertent opening.

19 Claims, 8 Drawing Sheets

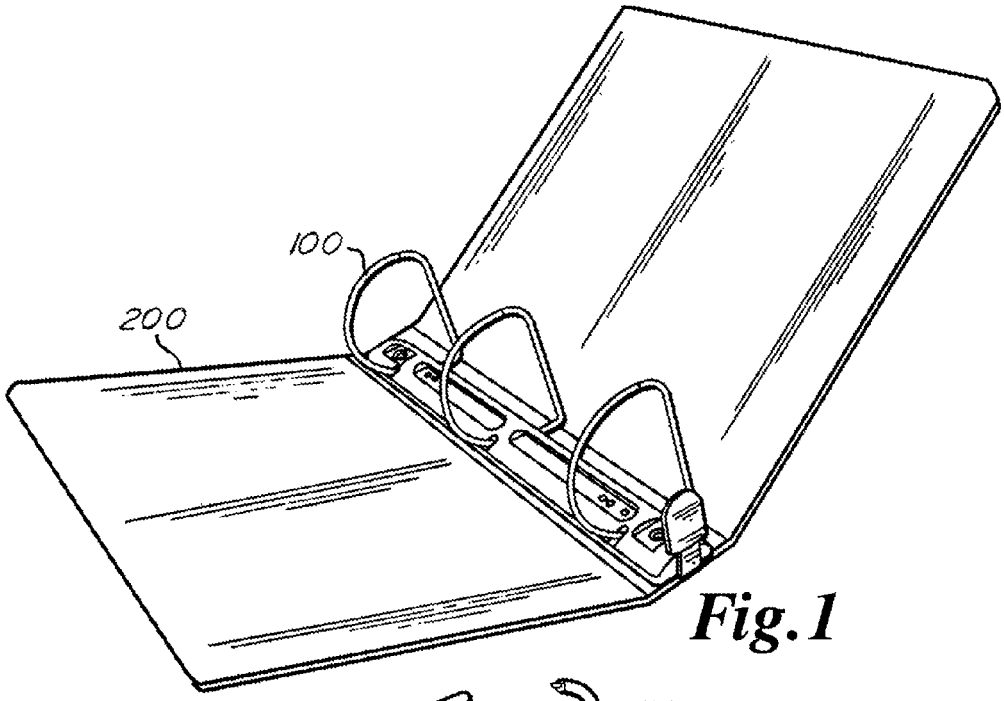
Fig.1
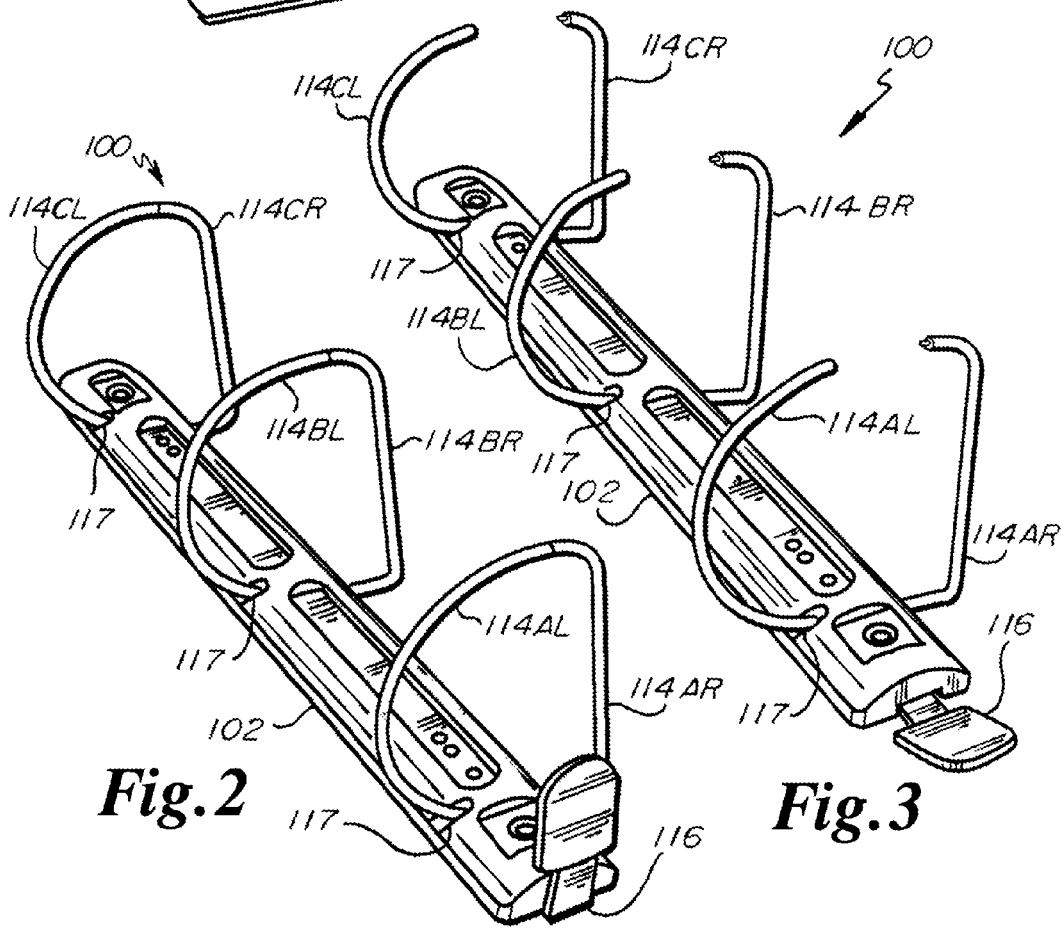
Fig.2
Fig.3

RING BINDER MECHANISM

RELATED APPLICATION

This application is a Continuation-in-Part of pending U.S. patent application Ser. No. 13/739,153 filed Jan. 11, 2013, the entire teachings of which are incorporated herein by reference.

FIELD OF THE INVENTION

The present invention is related to ring binders for retaining and organizing loose sheets of hole-punched paper. More specifically, the invention is related to the binder mechanism therein. Even more specifically, the invention is related to an improved self-locking arrangement for such a mechanism.

BACKGROUND

Ring binders capture and retain hole-punched sheets such as loose-leaf paper, printed pages and advertisements, and photo sleeves. Such binders organize the sheets to form notebooks, pamphlets, reports, or files. Such binders typically include clips or rings for engaging the sheets via their punched holes. The most popular of such binders is generically referred to as a "ring binder" and is most commonly embodied with two rings ("two-ring binder") or three rings ("three-ring binder") which capture each sheet through holes punched adjacent its left side edge. The rings are typically made of two substantially semi-circular half rings that are engageable to form a continuous loop and are disengageable to form an open discontinuous loop. The ring halves are capable of being opened in clamshell fashion to receive or dispense sheets, or closed to retain the sheets in book-like format.

A problem common to prior art ring binder mechanisms lies in the often sharp tips of the ring halves and the quick and forceful snapping action as these tips move between their opened and closed positions. To address this safety problem, most recent ring binder mechanisms include an activator for forcing the rings opened or closed without the user having to touch the ring halves. However, even with this safety advantage available most prior art ring binder mechanisms still allowed the user to choose between either opening and closing the rings with the activator or opening the rings by grasping and pulling the ring halves apart and closing the rings by pushing the ring halves together. Many users, accustomed to the older mechanism or attracted by the prominence of the rings for grasping, continued to use the older and more dangerous opening and closing method. To address this, some recent ring binder mechanisms included a locking mechanism for preventing opening of the rings by grasping and pulling the ring halves, and incorporated this locking mechanism into the actuator. This ensured that that closing the rings simultaneously and automatically locks the ring halves together to prevent one form pulling the ring halves apart, but allows the rings to be automatically unlocked for opening during activation of the actuator. In order to open such mechanisms, the user must push the actuator from its closed to its opened position. Such mechanism will be generically referred to herein as "auto-locking" or "self-locking" ring binder mechanisms, but while they have improved over previous mechanisms, they continue to suffer from disadvantages and flaws.

An auto-locking ring binder mechanism is taught in US Publication 2007/0286670, which exemplifies some of the disadvantages and failings of such prior art auto-locking mechanisms. A pair of movable locking elements is swung between an open state and a closed state by movement of two wire links connected to the actuator to enable or block motion of a pair of hinge plates from the closed to the open position. The locking elements are then swung back as the actuator is moved to the open position so that they align with slots in the hinge plates and thereby allow the hinge plates to open only by actuation of the actuator.

Although hypothetically functional as depicted, in practical manufacture and use this mechanism is found difficult to produce and unreliable. The distance between the points of attachment of the wire links to the locking elements and actuator is very difficult to accurately control through the assembly of so many loose-fitting components. Yet movement of the locking elements by the actuator and wire links must be very precise to ensure that the locking elements take exact locking and unlocking positions in relation to the slots in the hinge plates. In practice, this often requires a slight manual bending of the wire links at assembly to ensure that the wires precisely mate with the remainder of the assembled components and accurately control the locking elements. Such bend-ability requires that the links be made of the thin and flexible wire as shown. During real-world use, these wire links are found incapable of withstanding the common and reasonably anticipated misuses that such binders should be able to withstand.

The wires must be attached to the locking elements at an off-center position as depicted in order to cause the swinging of the elements, requiring the wire links to follow an arcuate path during their translation and create a non-straight line of force between the actuator, link, and element. It is common for occasional excessive forces to be inadvertently applied to the actuator or rings during unintentional misuse, such as to try to force the mechanism closed against an obstruction, and such forces are transmitted along the bendable wire links. With the non-straight arrangement required in this design, the wire links are easily bent by these forces and the distance between the points of attachment that was so carefully set during production is instantly changed. So the mechanism that was may have been functional at the time of manufacture is rendered nonfunctional by such common and reasonably anticipated misuse.

Additionally, the swinging motion of the locking elements in the above-described mechanism causes them to scrape against the hinge plates. Since the edges of the locking elements are naturally sharp and the swinging motion is arcuate, this causes wear and binding as the locking element rubs against the hinge plates, creates objectionable noise, obstructs the movement, and ultimately renders the mechanism unreliable and short-lived.

Numerous other prior art ring binder mechanisms employ linear translating locking elements, which share the disadvantage stated above because the sharp locking elements scrape against the hinge plates in a linear motion that causes similar wear and binding, noise, obstruction, and ultimate unreliability and short-life as well.

Additionally, because the binders in which such mechanisms are sold tend to be low-cost commodities, the mechanisms must be very inexpensive to manufacture. As a result, the mechanisms of the prior art must generally be constructed of thin gauge metal stampings and wires. The dimensions and shapes of such components are inherently difficult to control. This has resulted in an inability to manufacture many prior art mechanisms in a real-world application, even though such mechanisms promise to work perfectly as drawn.

Accordingly, disadvantages and flaws common to prior art ring binder mechanisms lie in the lack of reliability inherent in their designs. Disadvantages and flaws lie in the lack of structural rigidity dictated by their various constructions. Disadvantages and flaws lie in the manufacturing difficulties dictated by their complexity. Disadvantages and flaws lie in the high cost of manufacturing dictated by their numbers and types or components. And disadvantages and flaws lie in the lack of dimensional control of the components dictated by their required manufacturing methods. Further disadvantages and flaws will be readily appreciated by those familiar with the art.

There exists a need to overcome the lack of reliability inherent in the designs of prior art ring binders and ring binder mechanisms, and such is an object of the present invention. There exists a need to overcome the lack of structural rigidity dictated by the various constructions of prior art ring binders and ring binder mechanisms, and such is another object of the present invention. There exists a need to overcome the manufacturing difficulties dictated by the complexities of prior art ring binders and ring binder mechanisms, and such is another object of the present invention. There exists a need to overcome the high cost of manufacturing dictated by the numbers and types or components of prior art ring binders and ring binder mechanisms, and such is another object of the present invention. There exists the need for an arrangement and construction for a ring binder mechanism that is immune from the lack of dimensional control dictated by prior at arrangements and constructions, and such is another object of the present invention. Further needs and objects exist which are addressed by the present invention, as may become apparent by the included disclosure of an exemplary embodiment thereof.

SUMMARY OF THE INVENTION

The invention may be practiced with or embodied by a ring binder mechanism having a housing, a hinge plate connected to the housing and pivotable relative thereto, a ring member rigidly attached to the hinge plate and pivotable therewith relative to the housing, a locking element including a pinion, a bar, and an actuator.

The locking element may be affixed to the housing and rotatable relative thereto between an open orientation and a closed orientation. The locking element may allow pivoting of the hinge plate when in the open orientation and blocking pivoting of the hinge plate when in the closed orientation. The bar may include a rack engaging the pinion, the bar translatable relative to the housing between an open position and a closed position, wherein translation of the bar to the open position causes the rack to rotate the locking element to the open orientation and translation of the bar to the closed position causes the rack to rotate the locking element to the closed orientation.

The actuator may be attached to the housing and have a handle portion extending outside of the housing and an engagement portion within the housing operatively connected to the bar to translate the bar between the open and closed positions when the handle portion is moved between an open disposition and a closed disposition.

The rigid bar may further include a slot engaged by the locking element to guide the translation of the rigid bar. Both the slot and the translation of the rigid bar may be straight. The housing may be elongate and the translation of the rigid bar may be longitudinally aligned there-with. A spring may bias the rigid bar towards the closed position. The spring may be an extension spring engaging the rigid bar to the locking element.

The slot may include an open position stop and a closed position stop, the open position stop disposed against the locking element during the open orientation and preventing further rotation of the associated locking element there-beyond, and the closed position stop disposed against the locking element during the closed orientation and preventing further rotation of the locking element there-beyond. The slot may include the open position stop, closed position stop, and rack in one punch-out through the rigid bar.

The invention may also be practiced with or embodied by a ring binder mechanism having a housing, a pair of hinge plates connected to the housing and pivotable relative thereto between an open state and a closed state, a ring portion rigidly attached to each hinge plate and pivotable therewith relative to the housing between an open loop position wherein the ring portions of each hinge plate are disengaged to form an open loop during the open state and a closed loop position wherein the ring portions of each hinge plate are engaged to form a closed loop during the closed state, a locking element, a rigid bar, and an actuator.

The locking element may be affixed to the housing and may include a locking block with a pinion affixed thereto, the locking block and pinion rotatable together relative to the housing between an open orientation and a closed orientation, the locking block allowing pivoting of the hinge plate between the open and closed states when in the open orientation and blocking pivoting of the hinge plate from the closed state to the open state when in the closed orientation.

The rigid bar may engage one of the housing and locking element and include a rack engaging the pinion. The bar may be translatable relative to the housing between an open position and a closed position wherein translation of the bar to the open position causes the rack to rotate the pinion and force the locking block to the open orientation, and translation of the bar to the closed position causes the rack to rotate the pinion and force the locking block to the closed orientation.

The actuator may be attached to the housing and movable relative thereto between an open disposition and a closed disposition, the actuator having a handle portion extending outside of the housing and an engagement portion disposed within the housing and operatively connected to the rigid bar to translate the bar between the open and closed positions when the handle portion is moved between the open and closed dispositions.

The rigid bar may further include a slot engaged by the locking element to guide the translation of the rigid bar. Both the slot and the translation of the rigid bar may be straight. The housing may be elongate and the translation of the rigid bar may be longitudinally aligned there-with. A spring may bias the rigid bar towards the closed position. The spring may be an extension spring engaging the rigid bar to the locking element.

The slot may include an open position stop and a closed position stop, the open position stop disposed against the locking element during the open orientation and preventing further rotation of the associated locking element there-beyond, and the closed position stop disposed against the locking element during the closed orientation and preventing further rotation of the locking element there-beyond. The slot may include the open position stop, closed position stop, and rack in one punch-out through the rigid bar.

The invention may also be practiced with or embodied by a ring binder mechanism having an elongate housing, a plurality of locking elements each including a stationary bracket and a rotatable portion having a locking block with a pinion rigidly affixed thereto, wherein the stationary bracket is rigidly affixed to the elongate housing to capture the rotatable portion in rotational engagement therewith, an elongate rigid bar, a pair of elongate hinge plates retained within and by the housing, a plurality of mating ring halves, and an actuator.

The rotatable portion may have an open rotational orientation and a closed rotational orientation. The elongate rigid bar may be longitudinally disposed parallel to and within the elongate housing and may have a plurality of slots, each slot surrounding one of the locking elements with the rigid bar captured thereat in translational engagement with the housing by the associated locking element's stationary bracket. Each slot may include a rack engaging the surrounded locking element's pinion.

The elongate rigid bar may be translatable relative to the housing between an open translated position and a closed translated position, wherein translation of the bar to the open translated position causes each of the racks to rotate the associated pinion and force the associated rotational portion to its open rotational orientation, and translation of the bar to the closed translated position causes each of the racks to rotate the associated pinion and force the associated locking block to its closed rotational orientation.

The elongate hinge plates may be pivotable relative to the housing between an open state and a closed state. The mating ring halves may each be rigidly attached to one of the hinge plates and pivotable therewith relative to the housing between an open loop position wherein the mating ring halves of each hinge plate are disengaged to form an open loop during the open state and a closed loop position wherein the mating ring halves of each hinge plate are engaged to form a closed loop during the closed state, wherein each locking block allows pivoting of the hinge plates between the open and closed states when in its open rotational orientation and blocks pivoting of the hinge plates from the closed state to the open state when in its closed rotational orientation.

The actuator may be attached to the elongate housing and movable relative thereto between an open disposition and a closed disposition, the actuator having a handle portion extending outside of the housing and an engagement portion disposed within the housing and operatively connected to the rigid bar to translate the bar between the open and closed translated positions when the handle portion is moved between the open and closed dispositions.

The stationary bracket may include a base rigidly affixed to the housing, a pivot portion capturing the rotatable portion in rotational engagement with the housing, and an ear capturing the rigid bar in translational engagement with the housing. A spring may bias the rigid bar towards the closed translated position. The rigid bar and the stationary bracket may each further include a spring retainer and the spring may be an extension spring engaging and extending between the spring retainers of the rigid bar and the stationary bracket.

Each slot may include an open position stop and a closed position stop, the open position stop disposed against the associated locking element during the open rotational orientation and preventing further rotation of the associated locking element there-beyond, and the closed position stop disposed against the associated locking element during the closed rotational orientation and preventing further rotation of the associated locking element there-beyond. Each slot may include the open position stop, closed position stop, and rack in one punch-out through the elongate rigid bar.

The invention may also be practiced with or embodied by a ring binder mechanism having a housing, a hinge plate connected to the housing and pivotable relative thereto, a ring member rigidly attached to the hinge plate and pivotable therewith relative to the housing, a locking element including a pinion, a bar including a rack engaging the pinion, and an actuator attached to the housing and having a handle portion extending outside of the housing and an engagement portion within the housing. The locking element may be affixed to the housing and rotatable relative thereto between an open orientation and a closed orientation, the locking element allowing pivoting of the hinge plate when in the open orientation and blocking pivoting of the hinge plate when in the closed orientation. The bar may be translatable relative to the housing between an open position and a closed position, wherein translation of the bar to the open position causes the rack to rotate the locking element to the open orientation and translation of the bar to the closed position causes the rack to rotate the locking element to the closed orientation. And the actuator's engagement portion may be operatively connected to the bar to translate the bar between the open and closed positions when the handle portion is moved between an open disposition and a closed disposition. The locking element may further include a rotor having locking lugs projecting there-from towards the hinge plate, the rotor being co-rotational with the pinion such that the locking lugs block pivoting of the hinge plate when in the closed orientation.

The invention may also be practiced with or embodied by a ring binder mechanism having a housing, a pair of hinge plates connected to the housing and pivotable relative thereto between an open state and a closed state, a ring portion rigidly attached to each hinge plate and pivotable therewith relative to the housing between an open loop position wherein the ring portions of each hinge plate are disengaged to form an open loop during the open state and a closed loop position wherein the ring portions of each hinge plate are engaged to form a closed loop during the closed state, a locking element affixed to the housing and including a locking block with a pinion affixed thereto, the locking block and pinion rotatable together relative to the housing between an open orientation and a closed orientation, a rigid bar engaging one of the housing and locking element and comprising a rack engaging the pinion, and an actuator attached to the housing and movable relative thereto between an open disposition and a closed disposition. The locking block may allow pivoting of the hinge plate between the open and closed states when in the open orientation and may block pivoting of the hinge plate from the closed state to the open state when in the closed orientation. The rigid bar may be translatable relative to the housing between an open position and a closed position, wherein translation of the bar to the open position causes the rack to rotate the pinion and force the locking block to the open orientation, and translation of the bar to the closed position causes the rack to rotate the pinion and force the locking block to the closed orientation; and an actuator attached to the housing and movable relative thereto between an open disposition and a closed disposition. The actuator may have a handle portion extending outside of the housing and an engagement portion disposed within the housing and operatively connected to the rigid bar to translate the bar between the open and closed positions when the handle portion is moved between the open and closed dispositions. The locking block may further include a rotor having locking lugs projecting there-from towards the hinge plate such that the locking lugs block pivoting of the hinge plate when in the closed orientation.

The invention may also be practiced with or embodied by a ring binder mechanism having an elongate housing, one or more locking elements rotationally affixed to the elongate housing, each comprising a rotor portion comprising one or more locking blocks and a pinion co-rotational therewith, the one or more locking elements each having an open rotational orientation and a closed rotational orientation, an elongate rigid bar longitudinally disposed parallel to and within the elongate housing, a plurality of mating ring halves, a pair of elongate hinge plates retained within and by the housing and pivotable relative thereto between an open state and a closed state, and an actuator attached to the elongate housing and movable relative thereto between an open disposition and a closed disposition. The rigid bar may include one or more slots, each slot surrounding one of the pinions, with the rigid bar captured thereat in translational engagement with the housing by the associated locking element's rotor. Each slot may include a rack engaging the surrounded locking element's pinion. The elongate rigid bar may be translatable relative to the housing between an open translated position and a closed translated position, wherein translation of the bar to the open translated position causes each of the racks to rotate the associated pinion and force the associated rotational portion to its open rotational orientation, and translation of the bar to the closed translated position causes each of the racks to rotate the associated pinion and force the associated locking block to its closed rotational orientation. The plurality of mating ring halves may each be rigidly attached to one of the hinge plates and pivotable therewith relative to the housing between an open loop position wherein the mating ring halves of each hinge plate are disengaged to form an open loop during the open state and a closed loop position wherein the mating ring halves of each hinge plate are engaged to form a closed loop during the closed state. Each locking block may allow pivoting of the hinge plates between the open and closed states when in its open rotational orientation and may block pivoting of the hinge plates from the closed state to the open state when in its closed rotational orientation. The actuator may have a handle portion extending outside of the housing and an engagement portion disposed within the housing and operatively connected to the rigid bar to translate the bar between the open and closed translated positions when the handle portion is moved between the open and closed dispositions.

Further features and aspects of the invention are disclosed with more specificity in the Detailed Description and Drawings of an exemplary embodiment provided herein.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

FIG. 1 is a perspective view of a binder including a ring binder mechanism according to a first exemplary embodiment of the invention;

FIG. 2 is a top perspective view of the ring binder mechanism of FIG. 1 in a closed-locked position;

FIG. 3 is a top perspective view of the ring binder mechanism of FIG. 1 in an open position;

DETAILED DESCRIPTION

Figure 9:
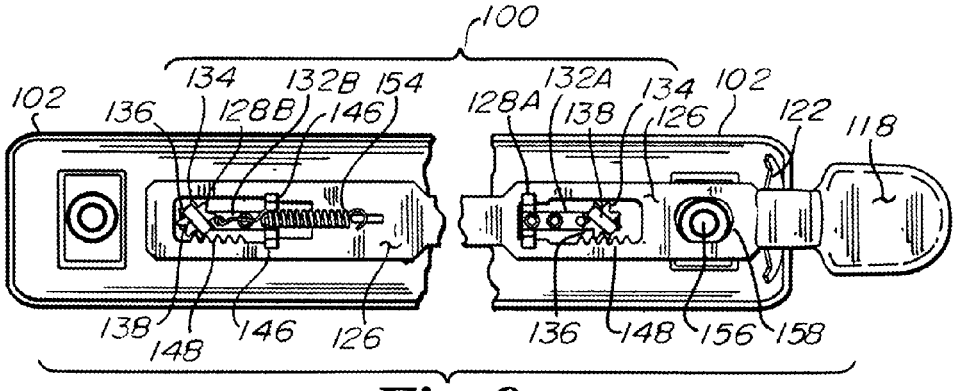
FIG. 9 is a bottom view of the ring binder mechanism of FIG. 1 in the open position with the hinge plates removed.

FIG. 1 shows a first exemplary ring binder mechanism 100 according to just one of the infinite number of possible embodiments of the present invention, mounted within a typical binder casing 200. It should be understood that neither the specific binder casing in which the mechanism is used, nor the means by which it is fastened to the casing, should limit the scope of the invention.

Referring to FIGS. 2 through 16, the ring binder mechanism 100 includes an elongate housing 102 made preferably of a flexible steel. The housing is substantially C-shaped in its minor cross section, as appreciated in FIGS. 5 and 6, so that it functions as a flexible spring.

A pair of rigid longitudinal hinge plates 106L and 106R, preferably made of steel, is positioned within the housing such that the outer edges 108L and 108R of the hinge plates fit within the curled-in side edges 112 of the housing. Three ring halves 114AL, 114BL, and 114CL are preferably made of steel and are disposed along and rigidly affixed to hinge plate 106L, preferably by welding. An equal plurality of ring halves 114AR, 114BR, and 114CR are disposed along and affixed to hinge plate 106R.

It should be noted that as used within this specification the appended claims, the term "halves" and "half" as applied to the ring halves only means to imply that the ring halves will form a full closed-loop ring when engaged as later explained, but is not intended to imply that any of the ring halves are a true fifty-percent semicircular half by the ordinary dictionary definition of the term. It should also be noted that within this description only and despite the orientation of the drawings, "upward" will generally be meant to mean away from the bottom of the binder mechanism which rests against the binder casing, "downward" will generally be meant to mean the opposite from "upward", "near" will generally be meant to mean towards the intended user, and "distal" will generally be meant to mean the opposite from "near".

Each ring half passes through a hole or cut-out 117 in the housing, or could extend down-under-around the curled-in edge, and upward to extend above the housing and has a terminal end adapted to engage a mating one of the ring halves of the other set to form a full and substantially circular closed-loop ring, as later-described.

Figure 5:
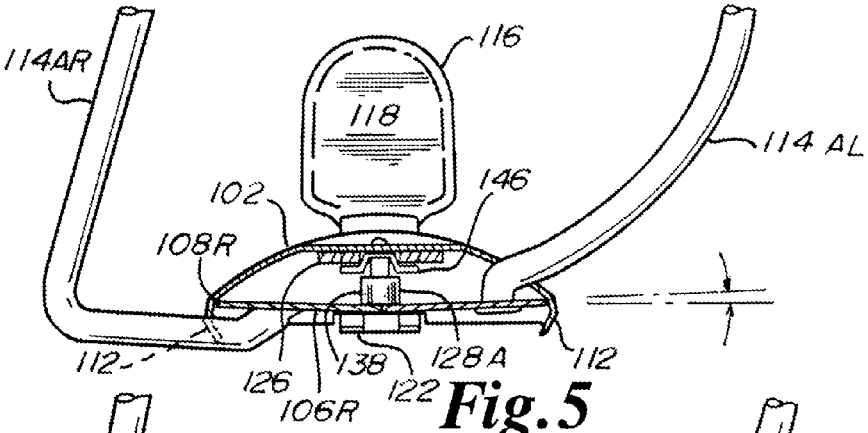
FIG. 5 is a partial cross-section view of the ring binder mechanism of FIG. 1 along line 5-5 of FIG. 8 in the closed-locked position.
Figure 6:
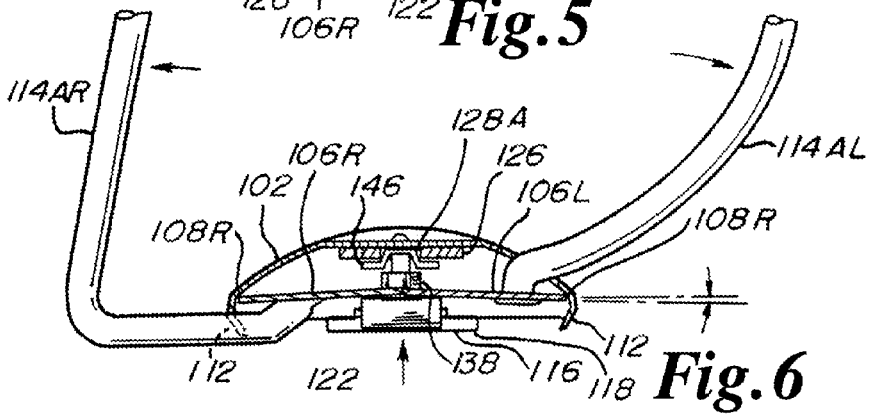
FIG. 6 is a partial cross-section view of the ring binder mechanism of FIG. 1 along line 5-5 of FIG. 8 in the open position.

As disposed within the housing side-by-side, the hinge plates have a combined width that is slightly wider that the width within the curled-in side edges to create an interference fit with the housing which, due to the flexibility of the housing through its C-shaped cross section, provides for two stable over-center hinge plate positions; the flexed downward position of FIG. 5 which corresponds to the binder mechanism's closed state, and the flexed upward position of FIG. 6 which corresponds to the binder mechanism's open state. The hinge plates and attached ring halves are movable between these two positions, but are limited by structure from moving beyond these positions and are unable to rest between these two positions absent an externally-applied stopping means.

Figure 13:
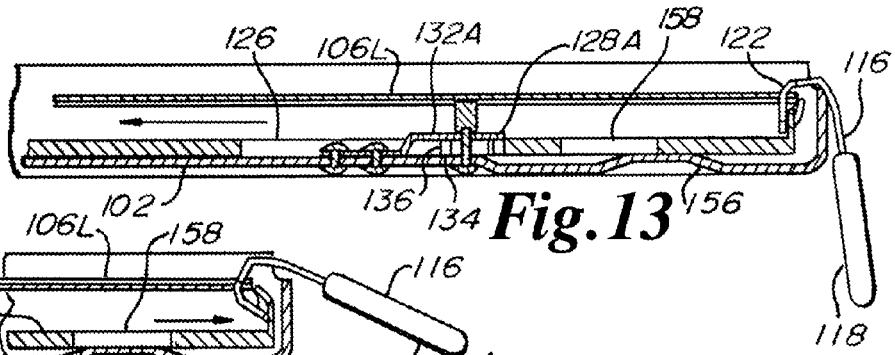
FIG. 13 is a partial cross sectional view of the ring binder mechanism of FIG. 1 in the closed-locked position taken at line 13-13 of FIG. 8.
Figure 14:
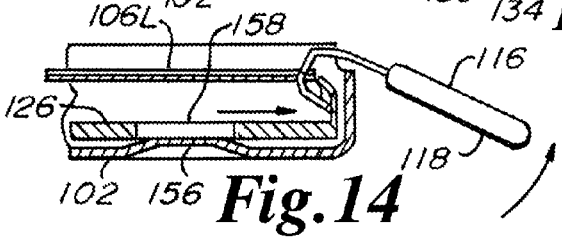
FIG. 14 is a partial cross sectional view of the ring binder mechanism of FIG. 1 in the open position taken at line 13-13 of FIG. 8.

An actuator 116 has a handle end 118 and a hinge plate end 122. Referring to FIGS. 13 and 14, the actuator is adapted to hingedly engage the near longitudinal end of the housing midway between the handle end and the hinge plate end and may be swung upwardly and downwardly there-about by a user grasping the handle end. The actuator flexibly engages the near longitudinal ends of both hinge plates with its hinge plate end so that such swinging will either force the hinge plates from the flexed downward position to the flexed upward position, or vice-versa.

When the hinge plates are forced upwardly from their closed state by swinging the actuator handle downwardly as shown in FIG. 13, the mating ring halves are forced outwardly and snap apart by the force of the housing spring as shown in FIGS. 3 and 6 so that the holes of hole-punched paper or similar materials may be placed over one set of ring halves. When the hinge plates are then forced back downwardly by swinging the actuator handle back upwardly as shown in FIG. 14, the mating ring halves are forced inwardly as shown in FIG. 5 and snap back inwardly by the force of the housing spring so that their mating terminal ends engage as shown in FIG. 2 to form loops that capture the paper. It should be appreciated by those familiar with the art that the arrangement as so far described is typical and represented by numerous prior art binder mechanisms, and those skilled in the art will be capable of surmising any undescribed details or substituting other known or obvious arrangements therefore.

Figure 15:
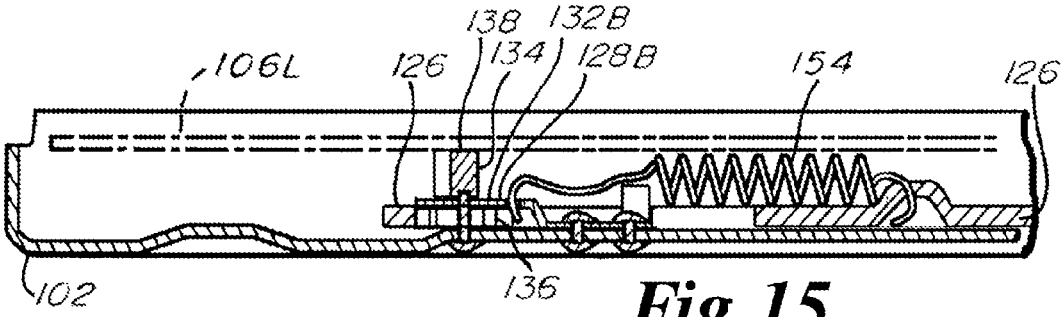
FIG. 15 is a partial cross sectional view of the distal locking element of the ring binder mechanism of FIG. 1 in the open position taken at line 15-15 of FIG. 10.
Figure 16:
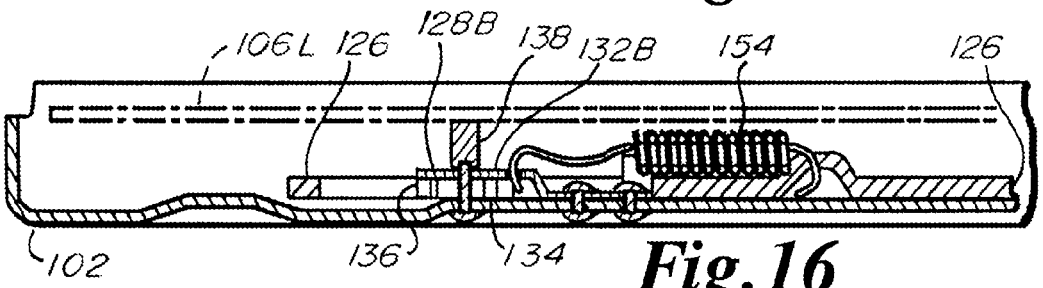
FIG. 16 is a partial cross sectional view of the distal locking element of the ring binder mechanism of FIG. 1 in the closed-locked position taken at line 15-15 of FIG. 10.

Rigid elongate translation bar 126, preferably made of steel plate, is disposed between hinge plates and the housing and is held to the housing and translatable relative thereto by features of locking elements 128A and 128B. As seen best in FIGS. 11, 13, and 14, the hinge plate end of the actuator is also adapted to flexibly engage the near end of the translation bar so that downward swinging of the actuator as shown in FIG. 14 forces nearward translation of the translation bar as shown in FIGS. 14 and 15. Upward swinging of the actuator as shown in FIG. 13 allows distally-directed translation of the translation bar as shown in FIGS. 13 and 16.

Near locking element 128A and distal locking element 128B each include a preferably steel bracket 132A or 132B, and a preferably steel rotor 134 which includes integrally formed pinion 136 and blocking lug 138. Each rotor is held to the housing by its associated bracket, which is secured to the housing by rivets or welding. The housing and bracket allow the rotor rotational freedom relative to thereto.

Figure 8:
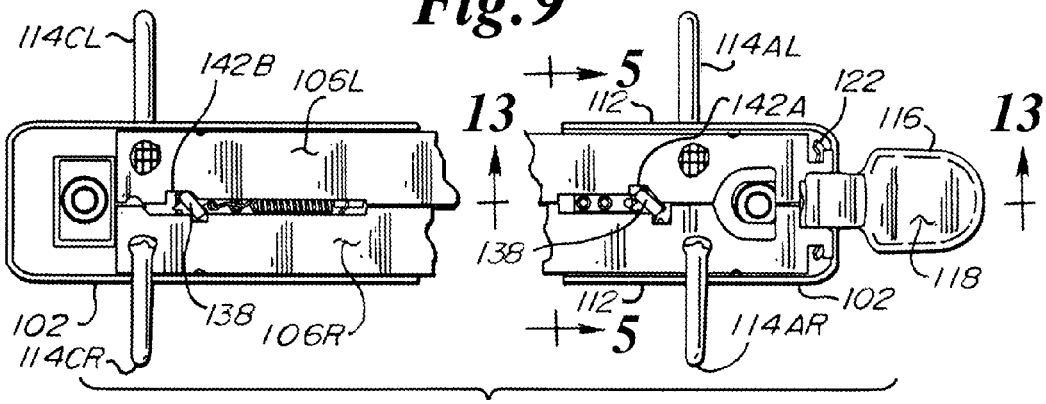
FIG. 8 is a bottom view of the ring binder mechanism of FIG. 1 in the open position.
Figure 4:
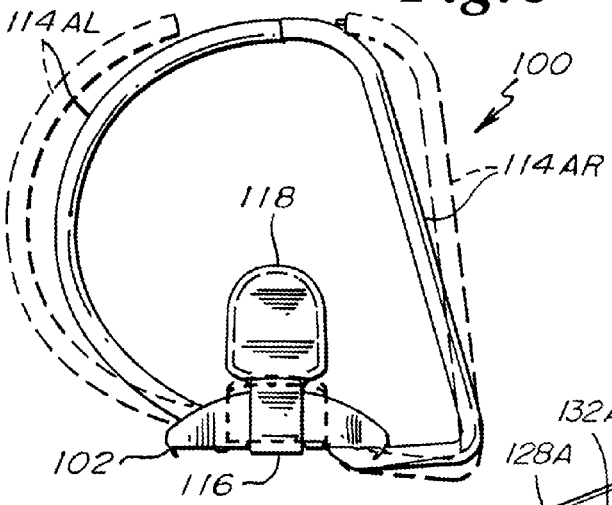
FIG. 4 is a near end view of the ring binder mechanism of FIG. 1 in the closed-locked position with the rings shown in dotted lines in the open position.
Figure 11:
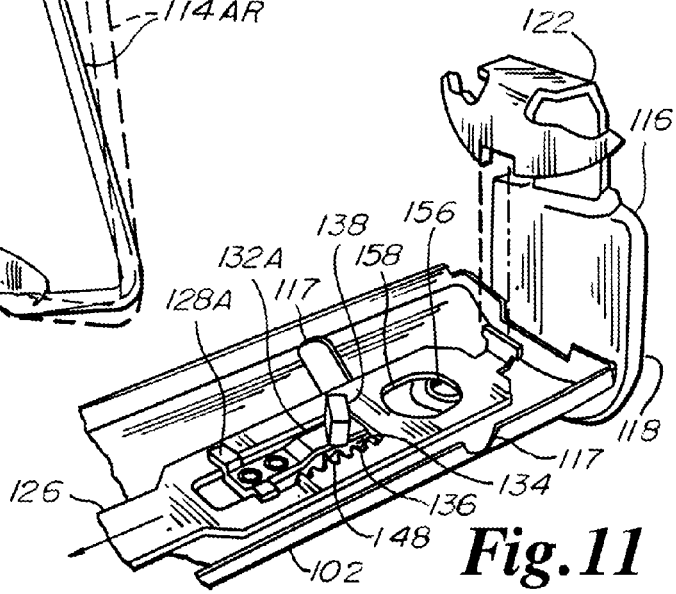
FIG. 11 is an exploded partial perspective view of the near end of the ring binder mechanism of FIG. 1 with the hinge plates removed.
Figure 7:
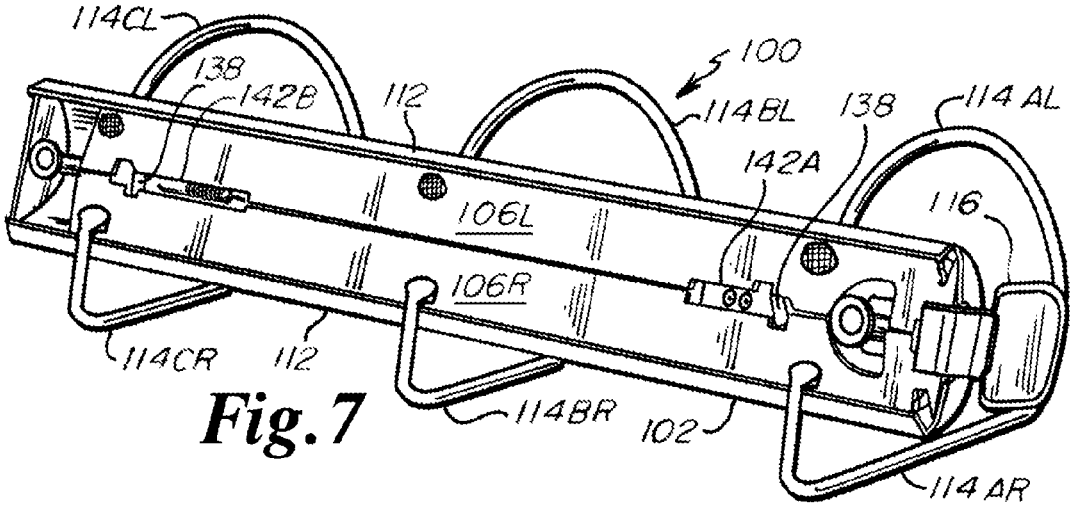
FIG. 7 is a bottom perspective view of the ring binder mechanism of FIG. 1 in the closed-locked position.
Figure 10:
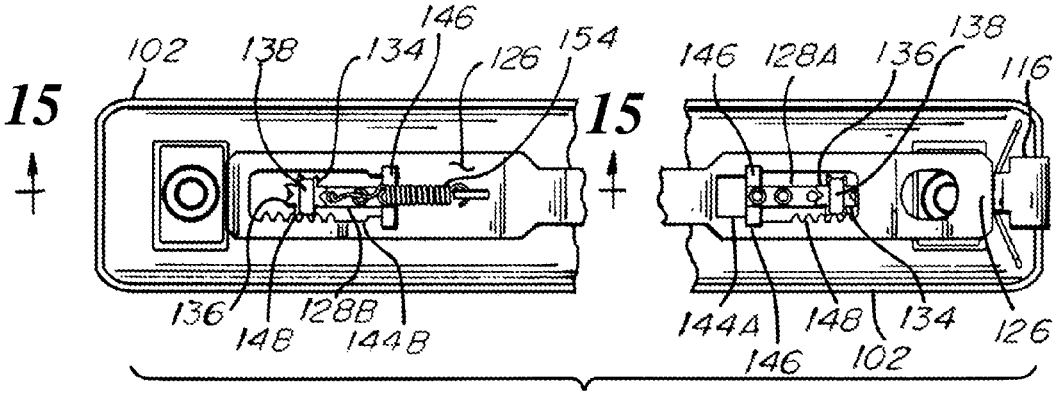
FIG. 10 is a bottom view of the ring binder mechanism of FIG. 1 in the closed-locked position with the hinge plates removed.

Referring to FIGS. 8 and 9, the blocking lugs are shaped to be avoided by key slots 142A and 142B in the hinge plates when the rotors are in the "open" rotational position shown, so that the hinge plates are free to pivot up or down relative to the housing. Referring to FIGS. 7 and 10, the blocking lugs are shaped to block pivoting of the hinge plates from the closed to the open position when the rotors are in the "locked" rotational position shown, by conflicting with slots 142A and 142 and interposing between the hinge plates and housing.

As previously mentioned, the translation bar is held to the housing by features of locking elements 128A and 128B, specifically the translation bar includes through-slots 144A and 144B which surround the locking elements and ears 146 of the brackets 132A and 132B extend outwardly beyond the sides of the slots to trap the translation bar against the housing while allow in the translation bar to more nearwardly and distally, limited only by interference between the ends of the slots with the associated locking elements at each end of the translation. This interference provides the later-referenced "translation stop".

Figure 12:
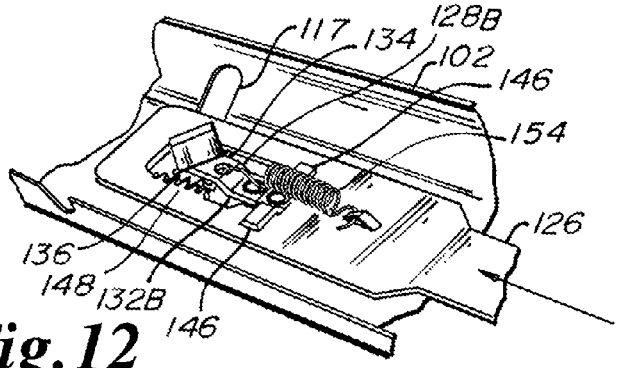
FIG. 12 is a partial perspective view of the distal locking element of the ring binder mechanism of FIG. 1 without the hinge plates.

Referring to FIG. 12, slots 144A and 144B also include racks 148 whose teeth engage the teeth of the associate pinions 136 such that translation of the translation bar causes the afore-described rotation of rotors 134 and blocking lugs 138. The slots, including the rack and the distal and near translation stops are very precisely formed by a single punch-out so that the relationship of the slots and the locking elements may be very precisely controlled even though the binder mechanism has many components manufactured and assembled by methods and equipment typically incapable of precision. This relationship between translation bar and locking elements, in particular the relationship between the racks, stops, pinions, and blocking lugs, enables very precise and repeatable control of the rotational position of the blocking lugs despite all of the inaccuracies of the remaining components. Additionally, because the motion of the blocking lugs is purely rotational, wear and binding common to prior art mechanisms is minimized and mechanism life is greatly extended.

Referring again to FIG. 12 and also to FIGS. 15 and 16, the translational bar is biased towards the distal end of its translation, and the mechanism is thereby biased towards a "locked closed" condition, by extension spring 154 which extends between the translation bar and the distal bracket 132B. Referring to FIG. 14, when the actuator pulls the translation bar nearwardly against the bias of the spring, it is desirable for the mechanism to remain in the open position until intentionally closed. This is accomplished by a mound 156 formed in the housing which engages a hole 158 in the translation bar to retain the translation bar in the nearwardly translated position. The holding force of this mound and hole is easily overcome when the actuator handle is lifted as shown in FIG. 13 and locked.

With the blocking lugs in their "locked closed" position, it becomes impossible for a user to inadvertently open the mechanism by pulling the ring halves apart directly. Such a force attempts to move the hinge plates upwardly towards the housing, but that motion is blocked by the blocking lugs.

It should be appreciated that the above-described arrangement greatly simplifies manufacturing, increases manufacturing yield percentage, and increases functionality, reliability, and life-expectancy over prior art mechanisms. Assembly of the locking elements and translation bar to the housing is greatly simplified. The translation bar is simply placed against the housing, the locking elements are placed through the slots of the translation bar and riveted to the housing to complete a perfectly functional and repeatable arrangement. There is no need to tweak or bend components, manage numerous loose components simultaneously, or retain components in position by hand during assembly. Due to the limited number is teeth in the rack and pinion, it is easy to recognize that the lug is rotated to the correct position prior to riveting, For instance, with an 8-tooth pinion, the assembler needs only recognize that the lug is within forty-five angular degrees of its intended rotational position to know that the assembly will be correct. And the relationship between the rotation of the blocking lugs and translation bar position is precisely set, rigid, and unalterable. Each locking element relates with the translation bar without any intervening components, and each blocking lug's positioning is precisely set and limited only by a singly-punched feature in the translation bar.

It should also be appreciated that the blocking elements include their rotational axes and spin on it rather than swing around outside of it in an arcuate path or translate slide linearly as in the afore-mentioned prior art. This eliminates the scraping, wear, noise, and related failures of the prior art and renders actuation between the closed and open positions much smoother and easier.

Figure 17:
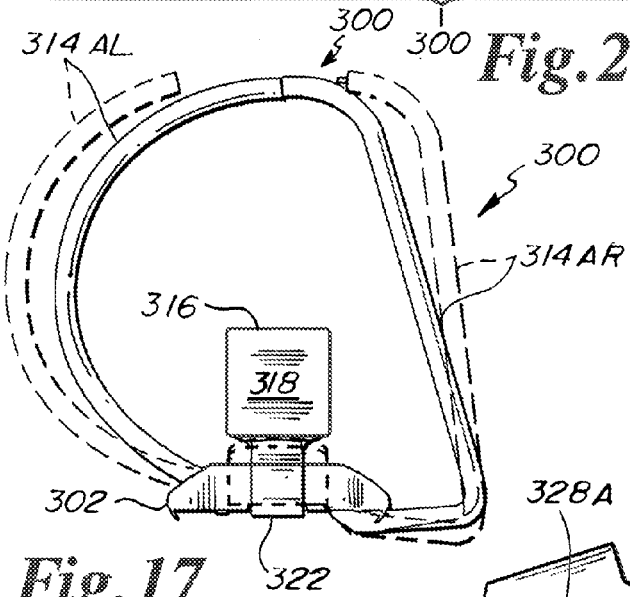
FIG. 17 is a near end view of the ring binder mechanism according to a second exemplary embodiment in the closed-locked position with the rings shown in dotted lines in the open position.

FIGS. 17 though 31 show a second exemplary ring binder mechanism 300 according to another one of the infinite number of possible embodiments of the present invention. The views of FIGS. 1 through 3 would be identical for this embodiment, so are not repeated, but reference will be made to those figures in the following portion of the description as they apply to this embodiment. Additionally, like item numbering is used for the second embodiment as for the first, excepting that where any particular item common to both embodiments has a "1XX" item number for the first embodiment, it is assigned a "3XX" item number for the second embodiment. It should again be understood that neither the specific binder casing in which the mechanism is used, nor the means by which it is fastened to the casing, should limit the scope of the invention.

The ring binder mechanism 300 includes an elongate housing 302 made preferably of a flexible steel. The housing is substantially C-shaped in its minor cross section, as appreciated in FIGS. 18 and 19, so that it functions as a flexible spring.

A pair of rigid longitudinal hinge plates 306L and 306R, preferably made of steel, is positioned within the housing such that the outer edges 308L and 308R of the hinge plates fit within the curled-in side edges 312 of the housing. Three ring halves 314AL, 314BL, and 314CL are preferably made of steel and are disposed along and rigidly affixed to hinge plate 306L, preferably by welding. An equal plurality of ring halves 314AR, 314BR, and 314CR are disposed along and affixed to hinge plate 306R.

Each ring half passes through a hole or cut-out 317 (item 117 in FIG. 1) in the housing, or could extend down-under-around the curled-in edge, and upward to extend above the housing and has a terminal end adapted to engage a mating one of the ring halves of the other set to form a full and substantially circular closed-loop ring, as later-described.

Figure 18:
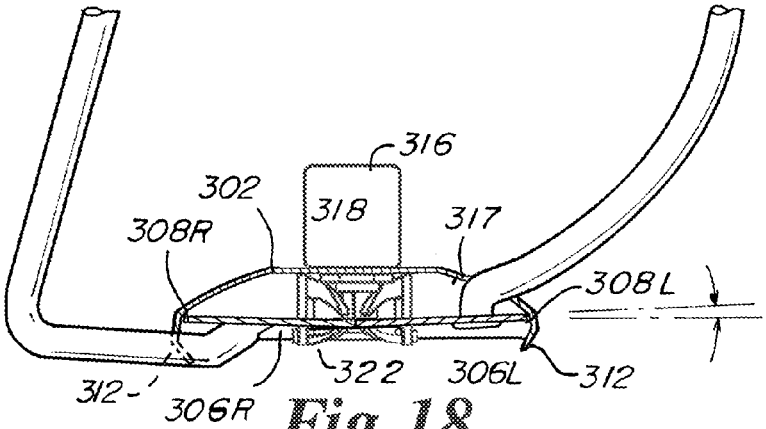
FIG. 18 is a partial cross-section view of the ring binder mechanism of FIG. 17 along line 18-18 of FIG. 21 in the closed-locked position.
Figure 19:
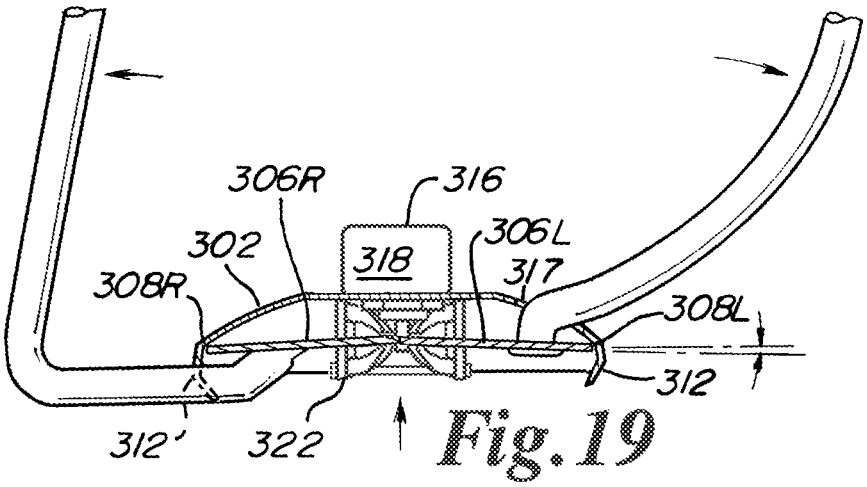
FIG. 19 is a partial cross-section view of the ring binder mechanism of FIG. 17 along line 18-18 of FIG. 21 in the open position.
Figure 30:
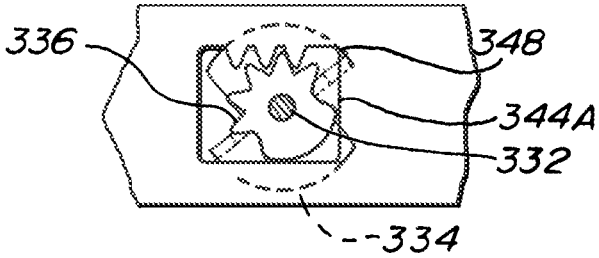
FIG. 30 is a partial cross sectional view of the pinion gear in the closed-locked position taken at line 30-30 of FIG. 26.
Figure 31:
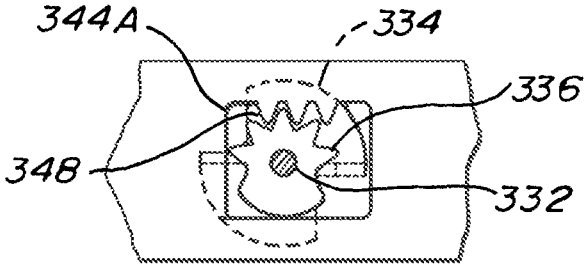
FIG. 31 is a partial cross sectional view of the pinion gear in the open position taken at line 31-31 of FIG. 27.

As disposed within the housing side-by-side, the hinge plates have a combined width that is slightly wider that the width within the curled-in side edges to create an interference fit with the housing which, due to the flexibility of the housing through its C-shaped cross section, provides for two stable over-center hinge plate positions; the flexed downward position of FIG. 18 which corresponds to the binder mechanism's closed state, and the flexed upward position of FIG. 19 which corresponds to the binder mechanism's open state. The hinge plates and attached ring halves are movable between these two positions, but are limited by structure from moving beyond these positions and are unable to rest between these two positions absent an externally-applied stopping means.

Figure 26:
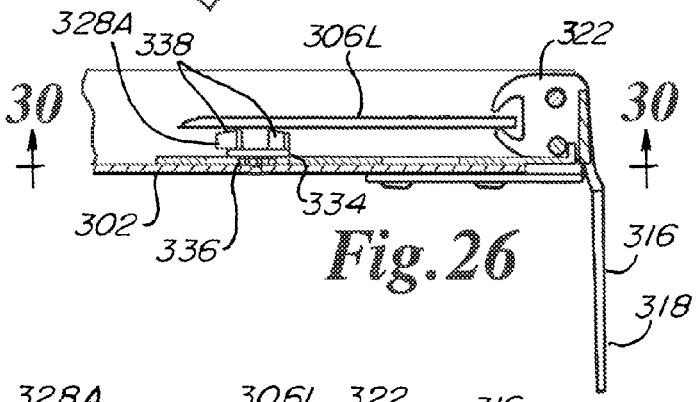
FIG. 26 is a partial cross sectional view of the ring binder mechanism of FIG. 17 in the closed-locked position taken at line 26-26 of FIG. 21.
Figure 27:
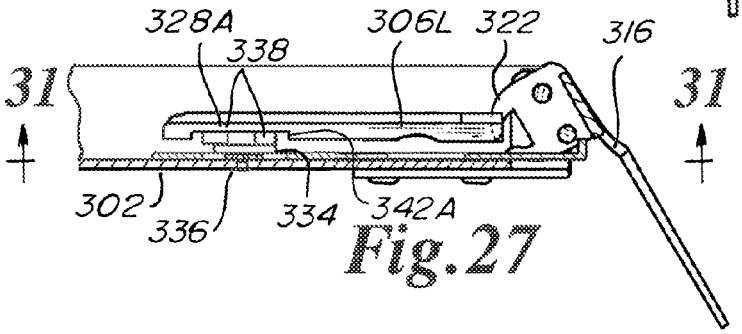
FIG. 27 is a partial cross sectional view of the ring binder mechanism of FIG. 17 in the open position taken at line 26-26 of FIG. 21.

An actuator 316 has a handle end 318 and a hinge plate end 322. Referring to FIGS. 26 and 27, the actuator is adapted to hingedly engage the near longitudinal end of the housing midway between the handle end and the hinge plate end and may be swung upwardly and downwardly there-about by a user grasping the handle end. The actuator grasps the near longitudinal ends of both hinge plates with its hinge plate end so that such swinging will either force the hinge plates from the flexed downward position to the flexed upward position, or vice-versa.

When the hinge plates are forced upwardly from their closed state by swinging the actuator handle downwardly as shown in FIG. 26, the mating ring halves are forced outwardly and snap apart by the force of the housing spring as shown in FIGS. 3 and 19 so that the holes of hole-punched paper or similar materials may be placed over one set of ring halves. When the hinge plates are then forced back downwardly by swinging the actuator handle back upwardly as shown in FIG. 27, the mating ring halves are forced inwardly as shown in FIG. 18 and snap back inwardly by the force of the housing spring so that their mating terminal ends engage as shown in FIG. 2 to form loops that capture the paper. It should be appreciated by those familiar with the art that the arrangement as so far described is typical and represented by numerous prior art binder mechanisms, and those skilled in the art will be capable of surmising any undescribed details or substituting other known or obvious arrangements therefore.

Figure 24:
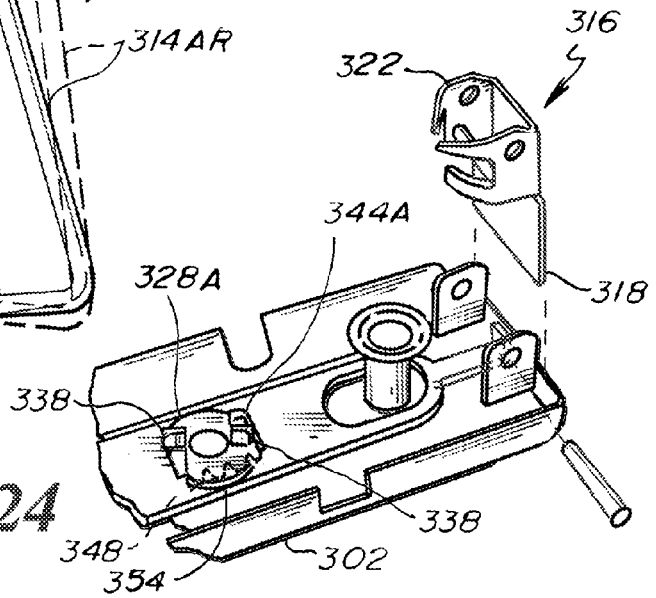
FIG. 24 is an exploded partial perspective view of the near end of the ring binder mechanism of FIG. 17 with the hinge plates removed.
Figure 28:
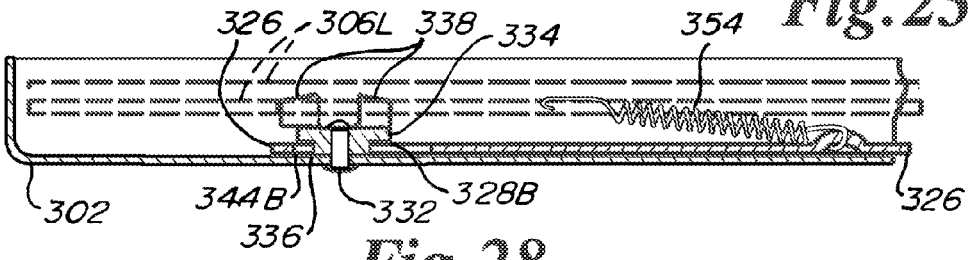
FIG. 28 is a partial cross sectional view of the distal locking element of the ring binder mechanism of FIG. 17 in the open position taken at line 28-28 of FIG. 23.
Figure 29:
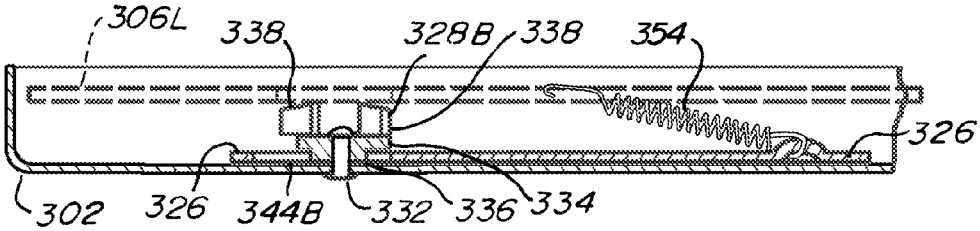
FIG. 29 is a partial cross sectional view of the distal locking element of the ring binder mechanism of FIG. 17 in the closed-locked position taken at line 28-28 of FIG. 23.

Rigid elongate translation bar 326, preferably made of steel plate, is disposed between hinge plates and the housing and is held to the housing and translatable relative thereto by features of locking elements 328A and 328B. As seen best in FIGS. 24, 26, and 27, the hinge plate end of the actuator is also adapted to flexibly engage the near end of the translation bar so that downward swinging of the actuator as shown in FIG. 27 forces nearward translation of the translation bar as shown in FIGS. 27 and 28. Upward swinging of the actuator as shown in FIG. 26 allows distally-directed translation of the translation bar as shown in FIGS. 26 and 29.

Near locking element 328A and distal locking element 328B are pivotally affixed to housing 302 by rivet 332. Each locking element includes a preferably steel rotor 334 which includes integrally formed pinion 336 and blocking lug 338. Each rotor is held to the housing by its associated bracket, which is secured to the housing by rivets or welding. The housing and bracket allow the rotor rotational freedom relative to thereto.

Figure 22:
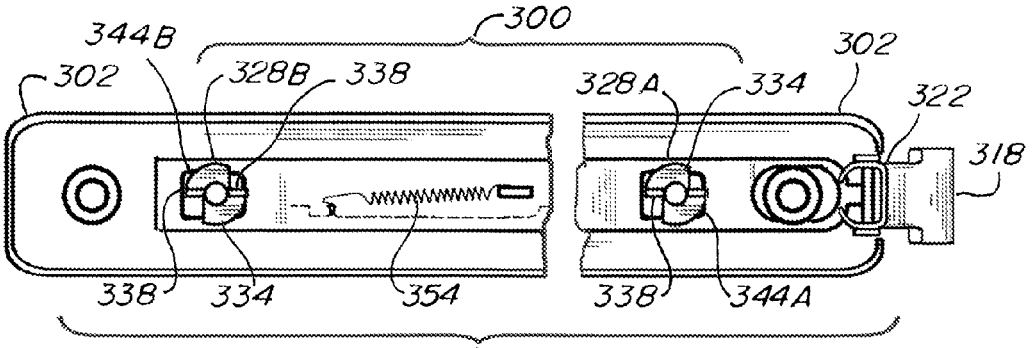
FIG. 22 is a bottom view of the ring binder mechanism of FIG. 17 in the open position with the hinge plates removed.
Figure 21:
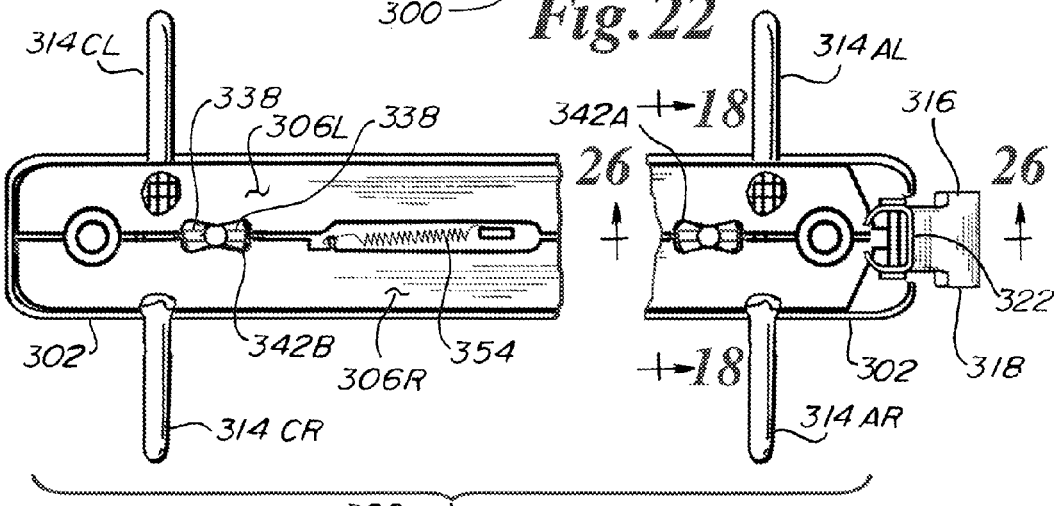
FIG. 21 is a bottom view of the ring binder mechanism of FIG. 17 in the open position.
Figure 20:
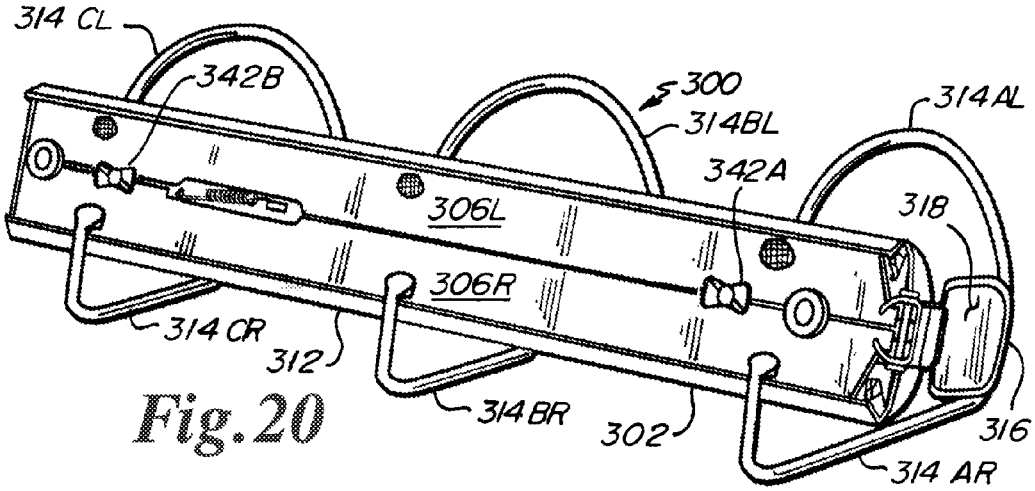
FIG. 20 is a bottom perspective view of the ring binder mechanism of FIG. 17 in the closed-locked position.
Figure 23:
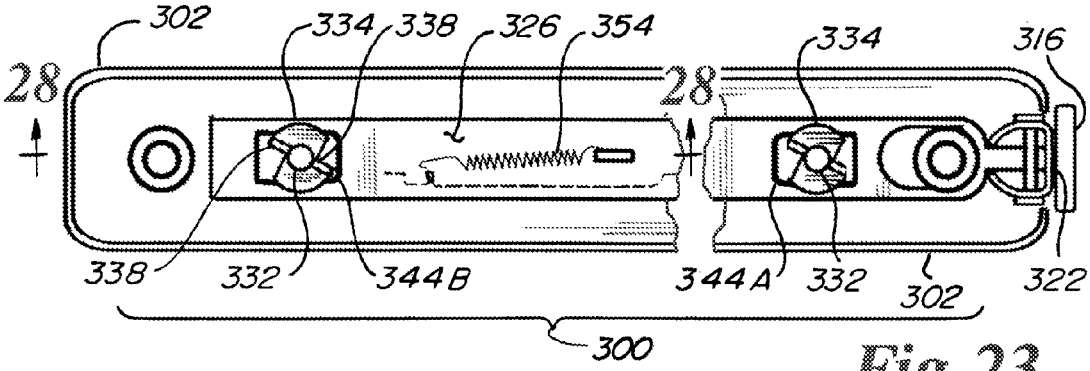
FIG. 23 is a bottom view of the ring binder mechanism of FIG. 17 in the closed-locked position with the hinge plates removed.

Referring to FIGS. 21 and 22, the blocking lugs are shaped to be avoided by key slots 342A and 342B in the hinge plates when the rotors are in the "open" rotational position shown, so that the hinge plates are free to pivot up or down relative to the housing. Referring to FIGS. 20 and 23, the blocking lugs are shaped to block pivoting of the hinge plates from the closed to the open position when the rotors are in the "locked" rotational position shown, by conflicting with slots 342A and 342B and interposing between the hinge plates and housing.

As previously mentioned, the translation bar is held to the housing by features of locking elements 328A and 328B, specifically the translation bar includes through-slots 344A and 344B which surround the pinions 336. The rotors 334 extend outwardly beyond the sides of the slots to trap the translation bar against the housing while allowing the translation bar to more nearwardly and distally, limited only by interference between the ends of the slots with the associated locking elements at each end of the translation. This interference provides the later-referenced "translation stop".

Figure 25:
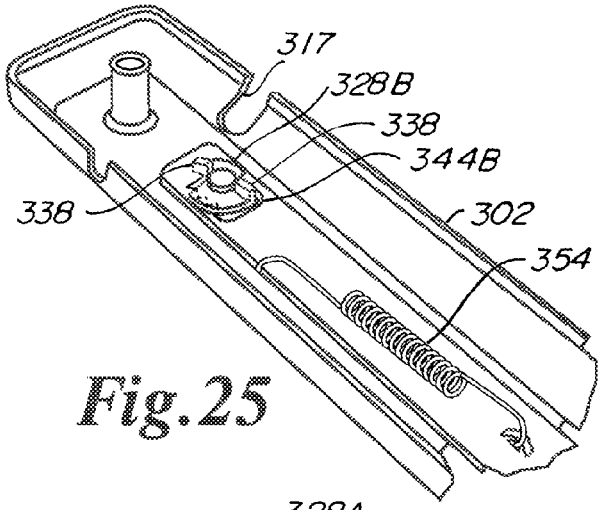
FIG. 25 is a partial perspective view of the distal locking element of the ring binder mechanism of FIG. 17 without the hinge plates.

Referring to FIG. 25, slots 344A and 344B also include racks 348 whose teeth engage the teeth of the associate pinions 336 such that translation of the translation bar causes the afore-described rotation of rotors 334 and blocking lugs 338. The slots, including the rack and the distal and near translation stops are very precisely formed by a single punch-out so that the relationship of the slots and the locking elements may be very precisely controlled even though the binder mechanism has many components manufactured and assembled by methods and equipment typically incapable of precision. This relationship between translation bar and locking elements, in particular the relationship between the racks, stops, pinions, and blocking lugs, enables very precise and repeatable control of the rotational position of the blocking lugs despite all of the inaccuracies of the remaining components. Additionally, because the motion of the blocking lugs is purely rotational, wear and binding common to prior art mechanisms is minimized and mechanism life is greatly extended.

Referring again to FIG. 25 and also to FIGS. 28 and 29, the translational bar is biased towards the distal end of its translation, and the mechanism is thereby biased towards a "locked closed" condition, by extension spring 354 which extends between the translation bar and either of the hinge plates 306L or 306R.

With the blocking lugs in their "locked closed" position, it becomes impossible for a user to inadvertently open the mechanism by pulling the ring halves apart directly. Such a force attempts to move the hinge plates upwardly towards the housing, but that motion is blocked by the blocking lugs.

FIGS. 26, 27, 30, and 31 show, in most detail, that the locking element 328A (representative also of 328B) engages the translation bar's slot 344A (representative also of 344B). The locking element is preferably cast of metal molded of plastic or such that the pinion 336, rotor 334 and lugs 338 are integrally formed. The engagement of the pinion and the rack on one side of the slot and of the pinion's outside diameter and the other side of the slot provide translational guidance. The ends of the slot contact the outside diameter of the pinion at each end of the translation bar's movement to limit the movement so that the movement of the translation bar is precisely controlled by the pinion to minimize inaccuracies.

It should be understood that the ring binder mechanism is not limited to the precise embodiments described above, and that various changes and modifications thereof may be effected by one skilled in the art without departing from the spirit or scope of the invention. For example, elements and/or features of different illustrative embodiments may be combined with each other and/or substituted for each other within the scope of this disclosure and appended claims. While the invention has been shown and described with reference to a specific exemplary embodiment, it should be understood by those skilled in the art that various changes in form and detail may be made without departing from the spirit and scope of the invention, and that the invention should therefore only be limited according to the following claims, including all equivalent interpretation to which they are entitled.

I claim:

1. A ring binder mechanism comprising:

a housing;

a hinge plate connected to the housing and pivotable relative thereto;

a ring member rigidly attached to the hinge plate and pivotable therewith relative to the housing;

a locking element comprising a pinion, the locking element affixed to the housing and rotatable relative thereto between an open orientation and a closed orientation, the locking element allowing pivoting of the hinge plate when in the open orientation and blocking pivoting of the hinge plate when in the closed orientation;

a bar comprising a rack engaging the pinion, the bar translatable relative to the housing between an open position and a closed position, wherein translation of the bar to the open position causes the rack to rotate the locking element to the open orientation and translation of the bar to the closed position causes the rack to rotate the locking element to the closed orientation; and an actuator attached to the housing and having a handle portion extending outside of the housing and an engagement portion within the housing operatively connected to the bar to translate the bar between the open and closed positions when the handle portion is moved between an open disposition and a closed disposition;

wherein the locking element further comprises a rotor having locking lugs projecting there-from towards the hinge plate; the rotor being co-rotational with the pinion such that the locking lugs block pivoting of the hinge plate when in the closed orientation.

2. The ring binder mechanism of claim 1, wherein the rigid bar further comprises a slot engaged by the locking element to guide the translation of the rigid bar.

3. The ring binder mechanism of claim 2 wherein both the slot and the translation of the rigid bar are straight.

4. The ring binder mechanism of claim 3 wherein the housing is elongate and the translation of the rigid bar is longitudinally aligned there-with.

5. The ring binder mechanism of claim 4 further comprising a spring biasing the rigid bar towards the closed position.

6. The ring binder mechanism of claim 5 wherein the spring is an extension spring engaging the rigid bar to the hinge plate.

7. The ring binder mechanism of claim 2 wherein the slot comprises an open position stop and a closed position stop, the open position stop disposed against the locking element during the open orientation and preventing further rotation of the locking element there-beyond, and the closed position stop disposed against the locking element during the closed orientation and preventing further rotation of the locking element there-beyond.

8. The ring binder mechanism of claim 7 wherein the slot comprises the rack.

9. The ring binder mechanism of claim 8 wherein the slot comprises the open position stop, closed position stop, and rack in one punch-out through the rigid bar.

10. A ring binder mechanism comprising:

a housing;

a pair of hinge plates connected to the housing and pivotable relative thereto between an open state and a closed state;

a ring portion rigidly attached to each hinge plate and pivotable therewith relative to the housing between an open loop position wherein the ring portions of each hinge plate are disengaged to form an open loop during the open state and a closed loop position wherein the ring portions of each hinge plate are engaged to form a closed loop during the closed state;

a locking element affixed to the housing and comprising a locking block with a pinion affixed thereto, the locking block and pinion rotatable together relative to the housing between an open orientation and a closed orientation, the locking block allowing pivoting of the hinge plate between the open and closed states when in the open orientation and blocking pivoting of the hinge plate from the closed state to the open state when in the closed orientation;

a rigid bar engaging one of the housing and locking element and comprising a rack engaging the pinion, the bar translatable relative to the housing between an open position and a closed position, wherein translation of the bar to the open position causes the rack to rotate the pinion and force the locking block to the open orientation, and translation of the bar to the closed position causes the rack to rotate the pinion and force the locking block to the closed orientation; and an actuator attached to the housing and movable relative thereto between an open disposition and a closed disposition, the actuator having a handle portion extending outside of the housing and an engagement portion disposed within the housing and operatively connected to the rigid bar to translate the bar between the open and closed positions when the handle portion is moved between the open and closed dispositions;

wherein the locking block further comprises a rotor having locking lugs projecting there-from towards the hinge plate such that the locking lugs block pivoting of the hinge plate when in the closed orientation.

11. The ring binder mechanism of claim 10, wherein the rigid bar further comprises a slot engaged by the locking element to guide the translation of the rigid bar.

12. The ring binder mechanism of claim 11 wherein both the slot and the translation of the rigid bar are straight.

13. The ring binder mechanism of claim 12 wherein the housing is elongate and the translation of the rigid bar is longitudinally aligned there-with.

14. The ring binder mechanism of claim 13 further comprising a spring biasing the rigid bar towards the closed position.

15. The ring binder mechanism of claim 14 wherein the spring is an extension spring engaging the rigid bar to the hinge plate.

16. The ring binder mechanism of claim 11 wherein the slot comprises an open position stop and a closed position stop, the open position stop disposed against the locking element during the open orientation and preventing further rotation of the locking element there-beyond, and the closed position stop disposed against the locking element during the closed orientation and preventing further rotation of the locking element there-beyond.

17. The ring binder mechanism of claim 16 wherein the slot comprises the rack.

18. The ring binder mechanism of claim 17 wherein the slot comprises the open position stop, closed position stop, and rack in one punch-out through the rigid bar.

19. A ring binder mechanism comprising:

an elongate housing;

one or more locking elements rotationally affixed to the elongate housing, each comprising a rotor portion comprising one or more locking blocks and a pinion co-rotational therewith, the one or more locking elements each having an open rotational orientation and a closed rotational orientation;

an elongate rigid bar longitudinally disposed parallel to and within the elongate housing and comprising one or more slots, each slot surrounding one of the pinions, with the rigid bar captured thereat in translational engagement with the housing by the associated locking element's rotor, and each slot comprising a rack engaging the surrounded locking element's pinion, the elongate rigid bar translatable relative to the housing between an open translated position and a closed translated position, wherein translation of the bar to the open translated position causes each of the racks to rotate the associated pinion and force the associated rotational portion to its open rotational orientation, and translation of the bar to the closed translated position causes each of the racks to rotate the associated pinion and force the associated locking block to its closed rotational orientation;

a pair of elongate hinge plates retained within and by the housing and pivotable relative thereto between an open state and a closed state;

a plurality of mating ring halves each rigidly attached to one of the hinge plates and pivotable therewith relative to the housing between an open loop position wherein the mating ring halves of each hinge plate are disengaged to form an open loop during the open state and a closed loop position wherein the mating ring halves of each hinge plate are engaged to form a closed loop during the closed state; and an actuator attached to the elongate housing and movable relative thereto between an open disposition and a closed disposition, the actuator having a handle portion extending outside of the housing and an engagement portion disposed within the housing and operatively connected to the rigid bar to translate the bar between the open and closed translated positions when the handle portion is moved between the open and closed dispositions;

wherein each locking block allows pivoting of the hinge plates between the open and closed states when in its open rotational orientation and blocks pivoting of the hinge plates from the closed state to the open state when in its closed rotational orientation.

* * * * *